US006554668B2

(12) United States Patent
Tanabe

(10) Patent No.: US 6,554,668 B2
(45) Date of Patent: Apr. 29, 2003

(54) LIFE JACKET

(75) Inventor: Koji Tanabe, Musashino (JP)

(73) Assignee: Tanabe Bogu Co., Ltd., Musashino (JP)

( * ) Notice: Subject to any disclaimer, the term of this patent is extended or adjusted under 35 U.S.C. 154(b) by 0 days.

(21) Appl. No.: 09/885,974

(22) Filed: Jun. 22, 2001

(65) Prior Publication Data

US 2002/0022419 A1 Feb. 21, 2002

(30) Foreign Application Priority Data

Jun. 23, 2000 (JP) ..... 2000-004385 U

(51) Int. Cl.[7] ..... B63C 9/08
(52) U.S. Cl. ..... 441/117; 441/108
(58) Field of Search ..... 441/114, 115, 441/116, 106, 108, 102

(56) References Cited

U.S. PATENT DOCUMENTS 1,480,417 A * 1/1924 Potter ..... 441/115
6,062,929 A * 5/2000 Hallstrom ..... 441/106

FOREIGN PATENT DOCUMENTS

JP 3009423 1/1995

* cited by examiner

*Primary Examiner*—Jesus D. Sotelo
(74) *Attorney, Agent, or Firm*—Armstrong, Westerman & Hattori, LLP

(57) ABSTRACT

A life jacket in including impact absorption materials on both sides of a hard protection material in which a high-impact fiber cloth is incorporated buoyant material on at least one impact absorption material provides buoyancy. The jacket includes front and back bodies of which the back body is longer than the front body and they are parted in the middle at the shoulder region, such that the interior material takes the form of a waist coat. By extending an upper portion of the hard protection material of the back body along a neck region of the front and back bodies, a head region retroversion protective portion is configured. Front and back bodies of the life jacket are fastened to the user by at least one belt.

13 Claims, 3 Drawing Sheets

LIFE JACKET

BACKGROUND OF THE INVENTION

1. Field of the Invention

The present invention relates to a life jacket, in particular, for a water motor sport, which is useful for a manipulator and a fellow passenger (hereinafter, referred as to an athlete) of a motor boat, a power board, or a jet-ski (a trade mark) to wear on the case of a race or the like.

2. Description of the Related Art

A life jacket which an athlete of a motor boat or the like wears in the race is required to be characterized by 1) good impact absorption, 2) high chest region protection, 3) strong protection of a neck region, 4) a good floating posture and 5) a good motility or the like.

Accordingly, as a conventional life jacket for a motor boat race, a life jacket, which is formed to satisfy the above described requirements, is generally used, for example, a life jacket described in Japanese Utility Model Publication No. 3009423 by the present applicant. This life jacket is provided with absorption materials on the opposite sides of a hard protection material in which a high-intensity fiber cloth such as a textile fabric or a knit fabric made of an aramid fiber is incorporated. At the same time, in this life jacket, an interior material provided with a floating material on the outside of one impact absorption material is packaged in cortexes of front and back bodies which are bonded in such a manner that the back body is formed to be longer than the front body and they are parted in the middle with the floating material side turned in. Further, in this life jacket, a pillow member is disposed on a neck region, a head region retroversion protective member is attached below the foregoing pillow member and a shoulder pad is attached to one shoulder region. Upon wearing this life jacket, the front and back bodies of the life jacket are fastened by a belt.

According to the above described life jacket, its interior material is thin and light, so that this life jacket achieves an effect when the athlete of the motor boat or the like wears it in the occasion of the race. However, its head region retroversion protective member is configured in such a manner that a member filled with a cushioned pad, is only attached beneath of the pillow member attached to the neck region, so that it can be said that the head region retroversion protective member is disengaged from the back body, namely, it is in a free state. Accordingly, upon participating in the race with wearing this life jacket in practice, for example, if the athlete drastically moves the body, its head region retroversion protective member is not capable of supporting the retroversion of his or her head completely, so that it has been rather difficult to protect a cervical vertebrae of a wearer. Additionally, in the case that the impact external force acts on a cervical region from a backward of the athlete, it has been rather difficult to effectively protect the cervical region from this external force.

SUMMARY OF THE INVENTION

The present invention has been made taking the foregoing problem into consideration, an object of the invention is to provide a life jacket, which is excellent in impact absorption and chest region protection and which is capable of effectively protecting a cervical region of an athlete even in the case that the athlete of the motor boat or the like wears this life jacket and which has a good motility in operation as well as which is capable of maintaining a good floating posture when the athlete who wears this life jacket drops off the boat or the like into water.

According to a first constitution of the life jacket of the present invention, which intends to solve the above described problems, the life jacket is provided with absorption materials on both of inner and outer sides of a hard protection material, in which a high-intensity fiber cloth such as a textile fabric or a knit fabric made of an aramid fiber is incorporated. At the same time, in this life jacket, an interior material provided with a floating material on the outside of one impact absorption material is packaged in cortexes of front and back bodies which are bonded in such a manner that the back body is formed to be longer than the front body and they are parted in the middle at a shoulder region, so that the interior material substantially takes the form of a waistcoat. Further, by extending an upper portion of the hard protection material of the foregoing back body of the life jacket along a neck region of the foregoing front and back bodies, a head region retroversion protective portion is configured. Upon wearing this life jacket, the front and back bodies of the life jacket are fastened by one piece of belt or two pieces of belts. The above described high-intensity fiber cloth may be selected from a glass fiber, a carbon fiber and other high-intensity chemical fiber in addition to the above mentioned aramid fiber.

In other words, if the athlete of the motor boat or the like wears the present life jacket on the occasion of the race, the hard protection material, the impact absorption material and the floating material of the interior material, which is packed in the cortex of the front body of the life jacket, protect the athlete, so that it is possible to prevent the athlete from being injured or it is possible to ease off the injure. Alternatively, the head region retroversion protective portion, which is formed with being integrated with the hard protection material packed in the cortex of the back body of the life jacket, effectively protects the cervical region, so that it is possible to prevent the cervical vertebrae of the athlete from being injured. Further, since the back body of the life jacket is formed longer, the back body is not crawled up even when the athlete folds his or her legs under himself or herself with taking an anteverted posture, so that a motility thereof becomes good and it is possible to effectively protect a hip of the athlete.

If the hard protection material and a shoulder pad are made of a reinforced glass or a reinforced plastic such as an FRP, they become light and they provide a protective effect. Alternatively, the floating member has buoyant force as a matter of course, and further has the impact absorption. By using a life jacket having water resistance and oil resistance, it is possible to obtain the forgoing effects more noticeably.

DESCRIPTION OF THE PREFERRED EMBODIMENTS

Figure 1:
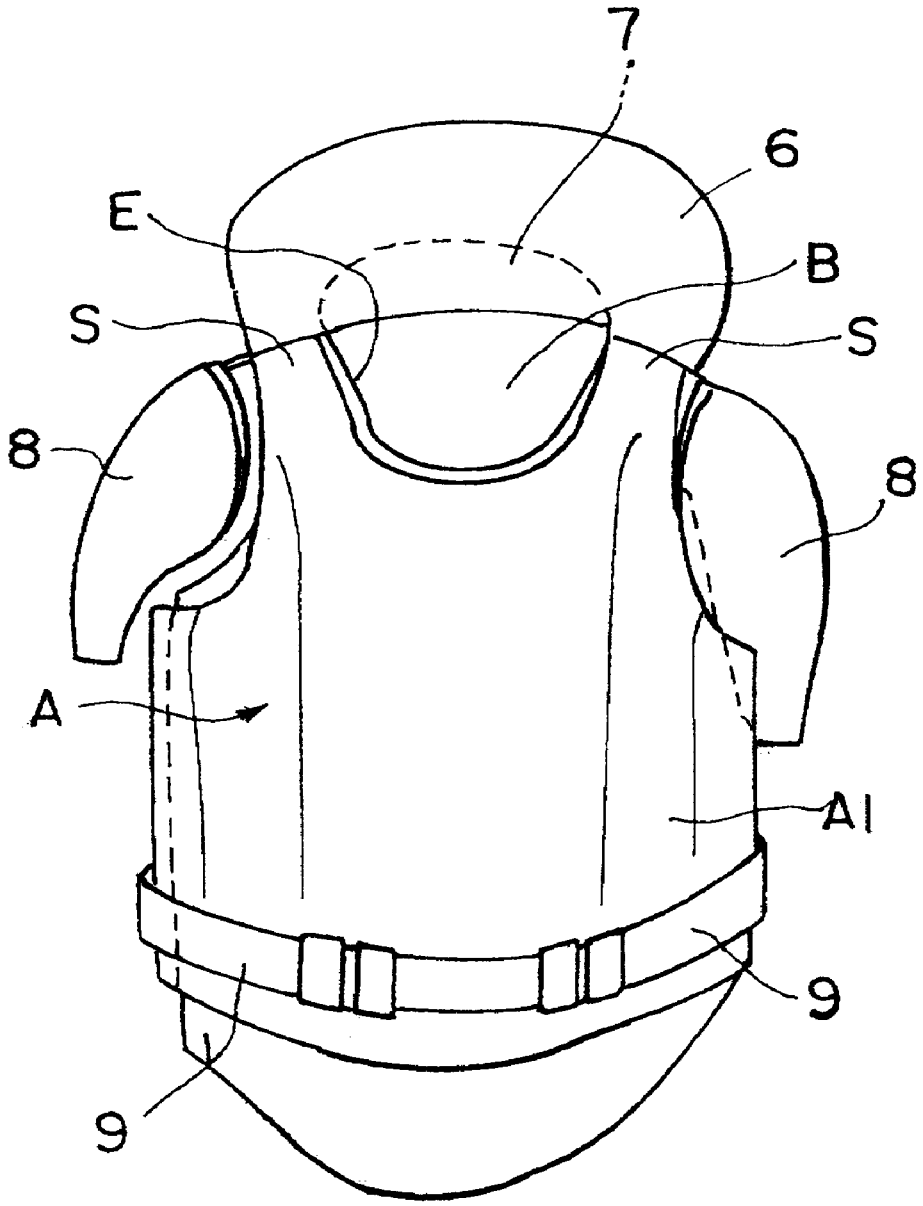
FIG. 1 is a front view of a life jacket according to an embodiment of the present invention.

Then, a preferred embodiment of the present invention will be explained below with reference to the drawings. FIG. 1 is a front view of a life jacket according to an embodiment of the present invention, FIG. 2 is a right side view of the life jacket shown in FIG. 1 and FIG. 3 is a cross sectional enlarged view for illustrating a substantial part of an interior material D.

Figure 2:
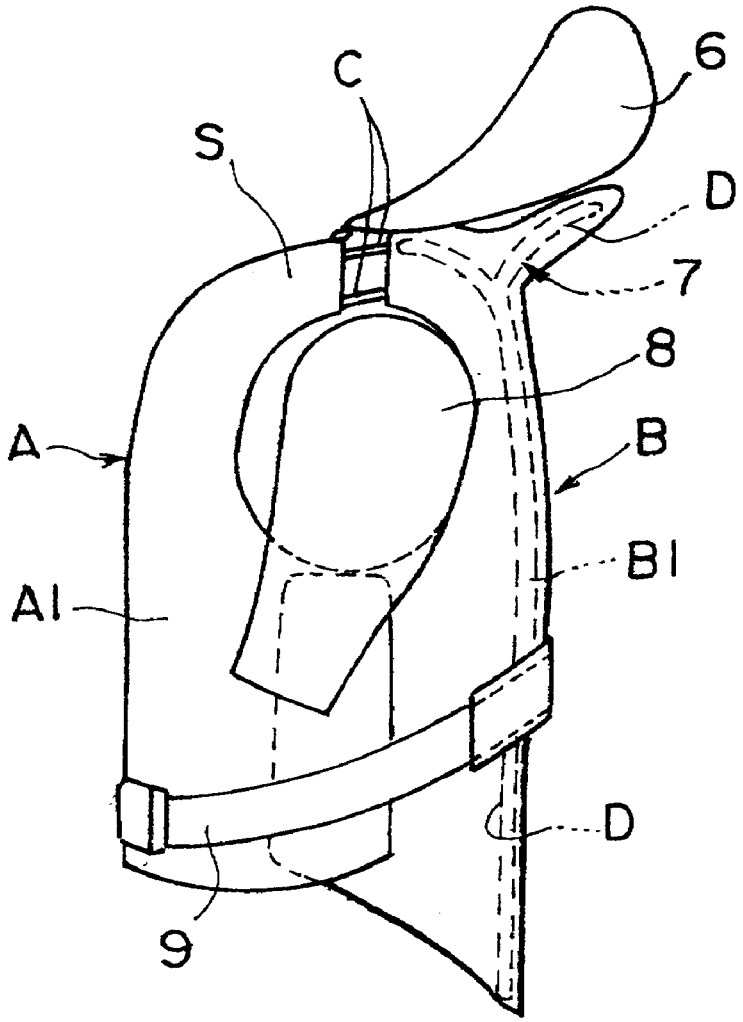
FIG. 2 is a right side view of the life jacket shown in FIG. 1.

In FIGS. 1 and 2, a reference numeral A denotes a front body of a life jacket body and a reference numeral B denotes a back body which is longer than the foregoing front body. These both bodies A and B are separated at a shoulder region S. Therefore, these both bodies A and B are formed in such a manner that, if they are bonded by a flexible belt such as a band C or a cord and lower portions of the both bodies A and B are unfolded back and forth, a wearer is capable of easily taking his or her head in a neck region E and easily taking his or her head out from the neck region E. Alternatively, the both bodies A and B are separately configured with being coupled by the band C at the shoulder region S, so that upper arms and a shoulder of the wearer are not tightened and the wearer is capable of moving his or her arms and shoulder even in the case that a lower portion of this jacket is fastened by at least one belt.

Figure 3:
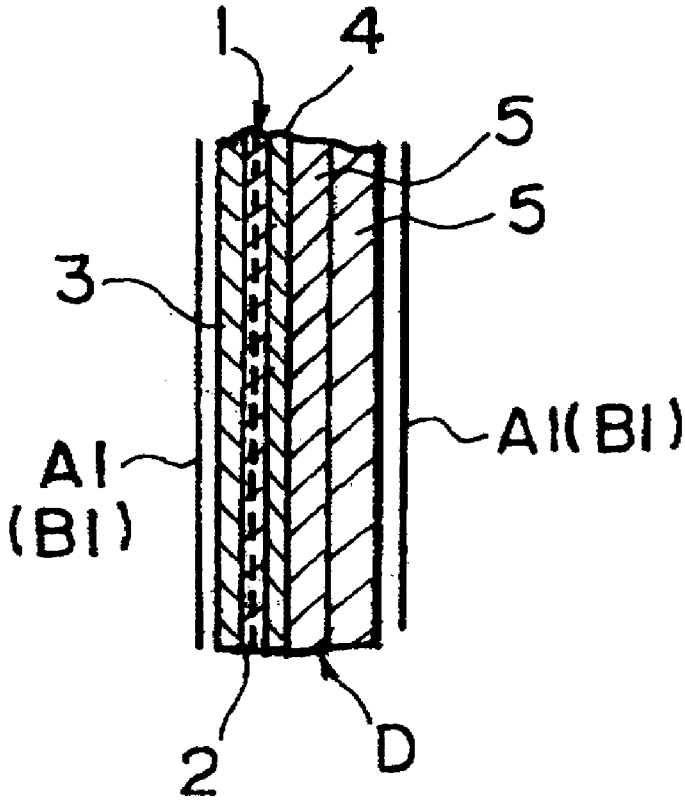
FIG. 3 is a cross sectional enlarged view for illustrating a substantial part of an interior material D.

As shown in FIG. 3, in the foregoing front and back bodies A and B, impact absorption materials 3 and 4 made of a plate-type foam are disposed on the opposite surfaces of a glass cloth 2 comprising a hard protection material, in which the aramid fiber cloth 1 is laminated and incorporated, within thin cortexes A1 and B1 made of a flexible chemical fiber cloth, respectively. At the same time, an interior material D formed by doubling and disposing floating materials 5, 5 made of a foam as same as that of the impact absorption materials 3 and 4 on the side of one impact absorption material 4 is packed with turning the side of the floating material 5 in. In this case, as the foregoing impact absorption materials 3 and 4, a bead foam and other foam or any foam may be available. Alternatively, in place of the aramid fiber made textile 1, a textile including a glass fiber or a carbon fiber, or a textile made of other high-intensity chemical fiber made textile may be used. Additionally, in place of the glass cloth 2, a board made of an FRP and other synthetic resin made board may be used.

A reference numeral 6 denotes a pillow member attached to a neck portion E of the foregoing back body B and a reference numeral 7 denotes a head region retroversion protective portion formed by extending an upper portion of an interior material (comprising a glass cloth 2, impact absorption material 3 and 4 and a floating material 5), which is packed in the back body B, with being integrated with the hard protection material 2. A purpose of the head region retroversion protective portion 7 is to prevent the damage of the cervical vertebrae of the wearer. In this case, the pillow member 6 is formed in such a manner that the interior material as well as the foregoing interior material D is packed therein or the cushion material is packed therein. Accordingly, even when the wearer is strongly hit on the head by the pillow member 6, the cervical vertebrae of the wearer is capable of being sufficiently protected because the head region retroversion protective portion 7 accepts the impact to absorb it. Therefore, when the wearer is in an accident such as a crash or the like by any chance, it is possible to prevent the wearer from suffering a so-called whiplash injury. Alternatively, the present life jacket for a jet ski has a model, in which the foregoing pillow member 6 is not provided.

A reference numeral 8 denotes a shoulder pad made of a plastic such as an FRP or the like attached to right and left shoulder regions S of the present life jacket and a reference numeral 9 denotes a belt, of which middle part is fixed on the back body B and, for fastening the front body A and the back body B upon wearing the present life jacket. Alternatively, in the example shown in FIGS. 1 and 2, one belt 9 is provided, however, two or more than two belts 9 may be provided. According to the present life jacket, there is a model such that the shoulder pad 8 is attached to only one of the left shoulder region or the right shoulder region or there is a model such that the shoulder pad 8 is not attached.

The above described present lifejacket is mainly worn by the athlete of a motor boat race and a power board race and the athlete of a jet ski or the like on the occasion of the race. The front and back bodies A and B are separated at the shoulder region S and they are flexibly bonded by the band C or the like, so that the wearer wears it in such a manner that he or she spreads the lower portions of the front and back bodies A and B and he or she pulls over this spread lower portions so that he or she takes his or her head out from the neck region E. Then, the wearer may fasten the belt 9 at the side of the front body A.

If the athlete of the motor boat race or the like wears the present life jacket in the above described manner and participates in the race, the present life jacket does not inhibit the mobility of the athlete. That is why the interior material of the present life jacket has a high intensity, however, it is thin and light, so that the mobility of the wearer thereof is excellent. Alternatively, even if the wearer is in an accident by any chance, it is possible to have a large protection area of the chest region and it is also possible to protect the chest region together with the effect of the foregoing interior material d, since the front body A and the back body B are flexibly bonded by the belt C or the like at the shoulder region S.

Alternatively, according to the present life jacket, since the length of the back body B is longer than that of the front body A, the back body is not crawled up even when the athlete takes an anteverted posture, so that this life jacket is comfortable to wear and the protection of the hip of the athlete can be improved. Particularly, according to the present life jacket, the cervical vertebrae is appropriately protected by the head region retroversion protective portion 7, which is formed on the upper portion of the interior material D of the neck portion E in the back body B with being integrated with its interior material D, so that it is possible to deter the damage of the cervical vertebrae before it happens or to the minimum in the unlikely event that the wearer is in the accident. Additionally, if the life jacket is provided with the pillow member 6, the effect of the life jacket becomes more noticeable. Alternately, if an air bag of an instantaneous distention type (not illustrated) is attached to the present life jacket from the opposite sides of the cervical region to the front surface thereof, it is possible to secure the head region more certainly above water granted that the wearer falls in water and he or she falls unconsciousness.

The above described present invention satisfies all of the particulars, which are required by the life jacket which is wore by the athlete of a water motor sport, such as the athlete of the motor boat race and the athlete of the jet ski race or the like, or a person who is fond of a water motor sport, so that the present life jacket is preferable as a life jacket for a water motor sport including the motor boat race. Additionally, the present life jacket is preferable as a life jacket for a person who is fond of riding a water bike such as a jet ski or the like.

What is claimed is:

1. A life jacket, comprising:

a front body adapted to be worn on the front of a user, wherein said front body, when worn by the user, extends from approximately the waist of the user to around the neckline of the user, comprising:

a front body laminated protection material having a front and a back surface and comprising a textile fiber sheet laminated between rigid sheets, and a first impact protection material on at least one of said surfaces of said front body laminated protection material;

a back body adapted to be worn on the back of the user, said back body comprising an upwardly extending portion, wherein said back body, when worn by the user, extends from approximately the waist of the user to above the neckline of the user, comprising:

a back body laminated protection material having a front and a back surface and comprising a fiber sheet laminated between rigid sheets, and a second impact protection material on at least one of said surfaces of said back body laminated protection material.

2. The life jacket according to claim 1, wherein said second impact protection material is disposed on both the front and back surfaces of said back body laminated protection material in said head region retroversion protective portion and said buoyant material is disposed on at least one side of said second impact protection material.

3. The life jacket according to claim 1, further comprising at least one shoulder pad is attached to at least one of said front and back bodies.

4. The life jacket according to claim 1, wherein said laminated protection material is made of at least one of a reinforced glass cloth and a reinforced plastic.

5. The life jacket according to claim 1, wherein said impact protection materials are adapted to provide a buoyant force to the user in water, and said impact absorption material has water resistance and oil resistance.

6. A life jacket in which impact absorption materials are provided on both of inner and outer sides of a hard protection material, in which a high-intensity fiber cloth such as a textile fabric or a knit fabric made of an aramid fiber is incorporated, and an interior material provided with a floating material on the outside of one impact absorption material is packaged in cortexes of front and back bodies which are bonded in such a manner that the back body is formed to be longer than the front body and they are parted in the middle at a shoulder region, so that the interior material substantially takes the form of a waistcoat and a pillow member, in which said impact absorption material is packaged, is attached to a neck region of said back body, wherein, by extending an upper portion of said hard protection material of said back body of said life jacket to a lower side of said pillow member, a head region retroversion protective portion is configured and said front and back bodies of said life jacket are fastened by at least one belt upon wearing said life jacket.

7. The life jacket according to claim 6, wherein, in said head region retroversion protective portion, said impact absorption materials are disposed on the opposite surfaces thereof and a floating material is disposed on one side of said impact absorption material.

8. The life jacket according to claim 2, wherein a shoulder pad is attached to one or both of said shoulder regions with being suspended.

9. The life jacket according to claim 6, wherein a hard protection material of a back body and a shoulder pad provided with said head region retroversion protective portion on upper portions thereof, are made of a reinforced glass cloth or a reinforced plastic.

10. The life jacket according to claim 6, wherein said floating material and said impact absorption material have impact absorption as well as a buoyant force and said impact absorption material has water resistance and oil resistance.

11. The life jacket of claim 1, wherein said fiber is selected from textile and knit fibers.

12. The life jacket of claim 11, wherein said fiber is selected from aramid fiber, glass fiber, and carbon fiber.

13. The life jacket of claim 1, wherein said rigid sheet is selected from glass cloth, fiberglass-reinforced plastic, and synthetic resin board.

* * * * *